US007004005B2

(12) United States Patent
Feldmann et al.

(10) Patent No.: US 7,004,005 B2
(45) Date of Patent: Feb. 28, 2006

(54) METHOD AND APPARATUS FOR PRODUCING PIPE FROM METAL PLATE

(75) Inventors: Uwe Feldmann, Rommerskirchen (DE); Manfred Kolbe, Mönchengladbach (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/617,577

(22) Filed: Jul. 11, 2003

(65) Prior Publication Data

US 2004/0055356 A1 Mar. 25, 2004

(30) Foreign Application Priority Data

Jul. 15, 2002 (DE) ..... 102 32 098

(51) Int. Cl.
*B21D 5/04* (2006.01)
*B21D 37/04* (2006.01)
*B21J 13/06* (2006.01)

(52) U.S. Cl. ..... 72/389.1; 72/389.2; 72/466.8; 72/466.9

(58) Field of Classification Search ..... 72/368, 72/389.1–389.4, 389.6, 389.8, 466.8, 466.9, 72/390.5
See application file for complete search history.

(56) References Cited

U.S. PATENT DOCUMENTS 1,914,979 A * 6/1933 Pueschel ..... 72/466.9
2,562,565 A * 7/1951 Merk ..... 72/466.9
2,763,924 A * 9/1956 Bellometti ..... 72/389.1
3,777,543 A * 12/1973 Kokkola et al. ..... 72/466.8
4,818,210 A * 4/1989 Van Dijk et al. ..... 72/466.8
5,272,904 A * 12/1993 Keumholz ..... 72/466.9

* cited by examiner

*Primary Examiner*—David B. Jones
(74) *Attorney, Agent, or Firm*—Herbert Dubno

(57) ABSTRACT

A bending press for bending metal plates for the production of large diameter pipe has an articulation for the upper die member which reduces bending moments as applied to the bending sword or ram. The articulation can be between the upper die and the foot of the bending sword and a second articulation can be provided between the bending sword and the head of it affixed to the head of the press.

9 Claims, 2 Drawing Sheets

METHOD AND APPARATUS FOR PRODUCING PIPE FROM METAL PLATE

FIELD OF THE INVENTION

Our present invention relates to an apparatus for producing pipe from metal plate and, more particularly, to a bending press for the progressive bending of metal plates to produce metal pipe. The invention also relates to a method of making metal pipe or to a method of operating such a bending press of the type which can have a press head provided with the hydraulic means required to force a ram and an upper shaping die against a metal plate to bend the latter in a lower die on the press bed.

The type of press with which the invention is primarily concerned has a ram which is in the form of a so-called bending sword, i.e. has a generally flat or uniform cross section structure over its height and at its foot carries the upper shaping die.

BACKGROUND OF THE INVENTION

Large diameter pipe can be manufactured by numerous processes which involve bending of the metal pipe to bring the edge of the plates together and enable welding to form a seam. Among these processes are the UOE process, the three-roll bending process, the spiral bending process and the pipe die pressing process. In pipe die pressing, one generally differentiates between a progressive folding process and the progressive die-shaping process.

In the production of pipe and especially large diameter pipe by the progressive die-shaping process, in a succession of steps, the metal plate, e.g. a steel plate, is progressively bent. The metal plate is generally prebent in a first step at its longitudinal edges in a process which is usually called crimping and which is intended to enable the longitudinal edges to ultimately be brought into butting relationship without the formation of a flat at the seam, which is to be formed by welding the butting edges together. This prebending is generally carried out in a separate edge-bending press.

The prebent plate is then subjected to progressive bending in a pipe die shaping press. The die-shaping press is comprised of a movable upper part and a stationary lower part. The stationary lower part can be a bed on which are provided a pair of bars which extend linearly parallel to one another along the press bed while a ram may be movable with the press head by the hydraulics coupled therewith to drive the upper bending die against the metal plates supported by the two bars. The ram of the press head may be a vertically disposed plate-like member which can be referred to as a bending sword and which may have the upper bending die affixed to it at its foot.

The spacing of the bars forming the lower shaping die may be variable to obtain different bend radii of curvature.

The prebent plate is generally slid into the pipe bending press and by driving of the ram against the plate, a bending force can be applied to the plate which produces a further deformation thereof. The process is repeated while gradually rotating the plate until a slit pipe or tube is formed, i.e. the edges of the pipe are brought together sufficiently that the gap between them corresponds only to the thickness of the bending sword forming the ram.

The time required for so bending the plate depends upon the number of strokes required by the press to progressively bend the plate inwardly and from the bending which can be accomplished during each stroke. The arcuate extent of the bend induced by each stroke is given by the width of the upper shaping die.

The upper shaping die which is mounted at the foot of the bending sword will normally have a width that is a multiple of the cross section or thickness of the bending sword and is a function of the radius of curvature to which the plate must be bent at each bending increment and is therefore a function of the inner radius of the pipe to be made.

The rounded upper bending die tends to engage the bending plate asymmetrically at last until the plate has been almost fully bent into a round configuration and thus the forces on the bending die are likewise asymmetrical at least for most of the bending steps. As a result bending moments are applied to the bending sword. To prevent the bending sword from being itself deformed, the bending sword of conventional presses must have greater cross sections than might otherwise be preferred and thus the slit which must be left in the rounded tube may have to be of considerable width.

OBJECTS OF THE INVENTION

It is, therefore, the principal object of the invention to provide an apparatus of the type described at the outset which can be used to bend metal plates and especially steel plates over a wider range of sizes and in a more versatile manner without overloading the bending sword of the apparatus.

More particularly it is an object of the invention to overcome the drawbacks of earlier systems and, therefore, enable a more slender bending ram to be used for the progressive bending of metal plates in the formation of large diameter pipe.

Still another object of the invention is to provide an apparatus in which the sword-shaped bending ram is less subject to bending moments than has hitherto been the case.

It is also an object of the invention to provide an improved bending method or method of operating a bending machine which is free from disadvantages of the prior art.

SUMMARY OF THE INVENTION

These objects are attained, in accordance with the invention in a bending press for bending metal plates in the production of pipe, especially large diameter pipe, which comprises:

a press bed formed with a lower die against which a metal plate can be pressed to bend the plate;

a bending ram extending over the length of the lower die and formed with an upper die of downwardly convex shape engageable with the plate to press the plate against the lower die under the plate; and an articulation for the upper die.

Advantageously, a pivot is provided between the upper shaping die and the foot of the ram or bending sword. The articulation or, more specifically, the pivot connection between the upper shaping die and the ram or bending sword ensures that the upper bending die can pivot about a horizontal longitudinal axis when it comes to bear upon the workpiece and thus adjust its position on the workpiece so that a minimum of bending moment is applied as a reaction force to the bending sword.

With further advance of the ram toward the bed of the press, the requisite bending force is applied while the upper bending die is caused to roll in its seat on the foot of the ram or bending sword and thus can apply a bending force over a relatively large deformation region as the plate to be bent comes to rest firmly on the two bars of the lower bending die. At this point deformation of the plate begins. The step by step deformation of the plate ultimately forms a pipe with the curvature of the upper die.

The bending sword itself may be additionally pivotally connected at its upper end to a head portion of the ram. With a double pivot or double articulation, any moment applied to the ram can be completely eliminated except for that which will result from friction at the two pivots. The friction in the relative movement between the upper bending die and the bending sword or between the bending sword and the upper part or head of the press can be controlled by selection of a lubricant of selection of the friction coefficients of the surfaces which bear on one another.

BRIEF DESCRIPTION OF THE DRAWING

The above and other objects, features, and advantages will become more readily apparent from the following description, reference being made to the accompanying drawing in which:

FIG. 2 is a side view of a bending sword illustrating a first embodiment; and.

SPECIFIC DESCRIPTION

Figure 1:
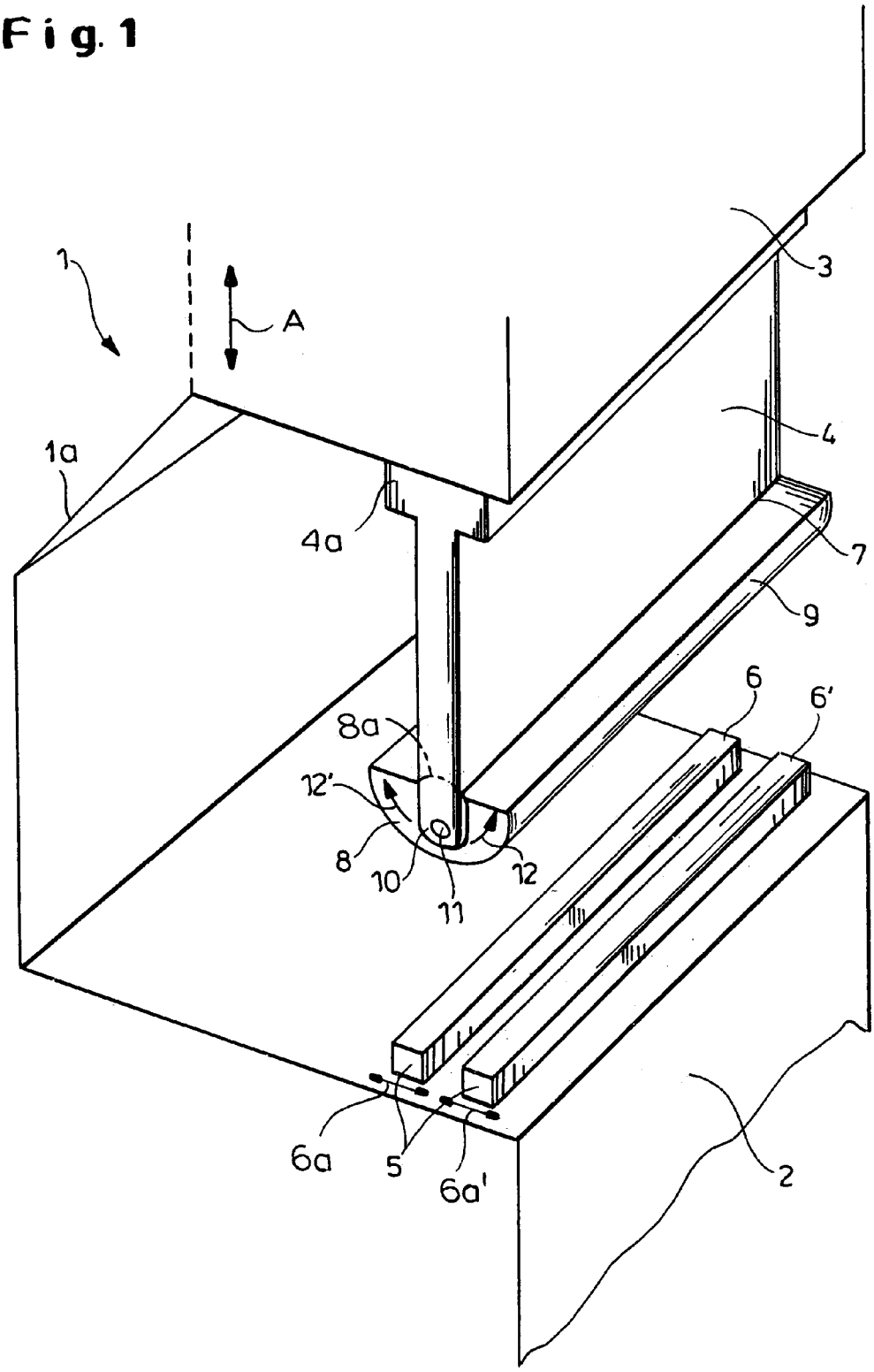
FIG. 1 is a diagrammatic perspective view of a C press illustrating the principles of the present invention.

FIG. 1 shows a pipe shaping press 1 which comprises a press bed 2 forming the lower portion of a C-shaped press and a head 3 forming the upper portion and containing one or more hydraulic cylinders which act upon the ram or bending sword 4 or displace the head relative to the bending sword 4 as represented by the arrow A. More particularly the head 4*a* of the bending sword 4 can be attached to the head 3 of the press which can be hydraulically displaced in the direction of arrow A relative to the frame 1*a* of the press. The result is a corresponding vertical movement of the bending sword or ram 4.

On the bed 2 of the press, a lower die 5 is provided in the form of a pair of bars 6 and 6' which may be equipped with lead screw mechanisms or the like as represented by the arrows 6*a* and 6*a*' for shifting these bars toward and away from one another.

At the bottom of the bending sword 4 an upper bending die 8 is provided. Depending upon the internal radius and shape of the pipe to be fabricated, the upper bending die 8 may be interchangeable with others upon extraction of a pivot pin 11 by means of which the die 8 can be held on the foot 7 of the bending sword 4. The underside 9 of the die 8 has a radius of curvature which can correspond to the inner radius of the pipe to be formed, and has a convex curvature.

Figure 2:
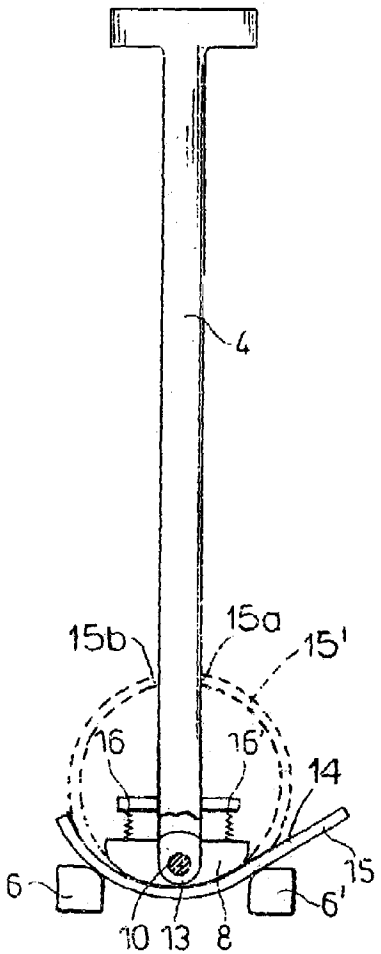

The upper die member 8 is not rigidly connected to the foot 7 of the bending sword 4 but rather, as indicated in FIGS. 1 and 2, can pivot about a pivot pin 11 supported in extensions 4*a* of the bending sword 4 to one side or the other as indicated by the arrows 12'. The result is an articulation 10 between the member 8 and the bending sword 4. While one articulation has been provided in the embodiments of FIGS. 1 and 2, multiple articulations along the length of the bending die 8 can be provided as long as they define a pivot axis which extends parallel to the longitudinal direction of the pipe to be formed and to the bars 5. As can be seen also from FIGS. 1 and 2, an upper part of the die 8 may be convexly curved at 8*a* and can be received in a cylindrically concave seat at the bottom of the bending sword 4 to ensure effective force transmission between the bending sword and the die 8. The concave seat and the convex surface 8*a* may have their centers of curvature on the longitudinal axis defined by the pivot pin or pins 11. In FIG. 2 the axis has been shown at 13. The axis 13 of the articulation 10 is located, to avoid detrimental bending moments, in the region of the upper surface 14 and a plate 15 to be bent into the tube shape. The inwardly crimped edges of the plate 15 have not been shown in FIG. 2.

The exact position assumed by the member 8 depends upon frictional contact between the member 8 and the plate 15, the position of the plate 15 on the bars 6, the pressing force and the shape of the plate as previously formed therein in other pressing steps. To return the die 8 to its starting position in an unloaded state, a pair of spring elements 16, 16', braced between the die 8 and the bending sword 4 are provided. At 15' in FIG. 2 we have shown a fully bent plate, i.e. the pipe prior to welding of the edges 15*a* and 15*b* together, e.g. by a submerged arc process.

Figure 3:
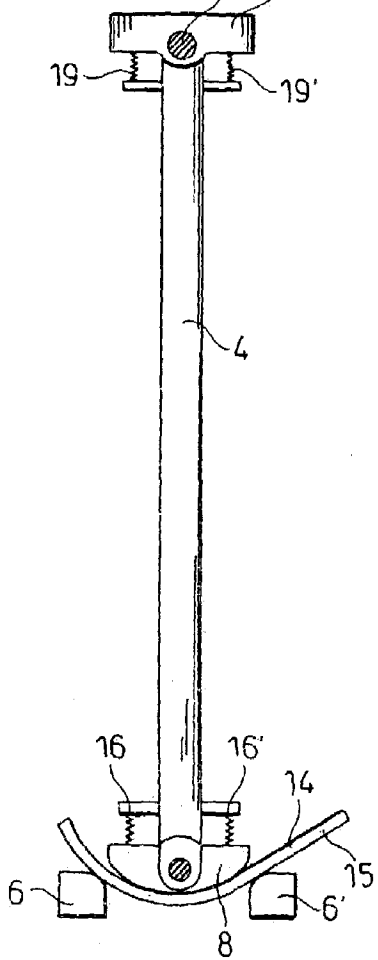
FIG. 3 is a side view of the bending sword illustrating a second embodiment of the invention.

In FIG. 3 a second embodiment of the invention has been illustrated in which an articulation is provided, in addition, between the upper part of the bending sword 4 and the lower part thereof or between the bending sword 4 and the upper member or head 3 of the press. In this case, the articulation 18 is formed between the head 17 of the bending sword 4 and the remainder thereof. Spring elements 19 and 19' are braced between the head and the remainder of the bending sword 4 to return the latter to its vertical neutral position in the nonloaded state. In the embodiment of FIG. 3 there is a double articulation, one at each end of he bending sword 4. As an alternative, the upper articulation can be used without the lower articulation although this is not preferred.

We claim:

1. A bending press for bending metal plates in the production of pipe, comprising:

a press bed formed with a lower die against which a metal plate can be pressed to bend said plate;

a bending ram extending over the length of said lower die and formed with an upper die of downwardly convex shape engageable with said plate to press said plate against said lower die under said plate; and an articulation for said upper die, said articulation for said upper die including a pivot having a pivot axis extending parallel to said lower die between said upper die and a foot of said ram and forming a pivot axis for said upper die close to an upper surface of said plate.

2. The bending press defined in claim 1 wherein said articulation includes a pivot for said ram at an upper end thereof having a pivot axis parallel to said die.

3. The bending press defined in claim 2, further comprising at least one force-restoring member braced to bias said upper die back into an original position upon displacement of said upper die about said articulation.

4. The bending press defined in claim 3 wherein said upper die is articulated on said ram, said force-restoring member including a spring braced between said ram and said upper die.

5. The bending press defined in claim 3 wherein said ram is formed with said articulation at an upper end thereof and said force-restoring member is braced across said articulation.

6. The bending press defined in claim 3 wherein said force-restoring member includes a pair of springs.

7. The bending press defined in claim 1 wherein said ram comprises a generally upright plate of substantially uniform wall thickness over its height.

8. A method of bending a metal plate in the formation of large diameter pipe comprising the steps of repeatedly pressing a metal plate by an upper die at the bottom of a rain driven by a press head from above against a lower die on a press bed and in which the upper and lower die extend over the length of the plate to bend the plate;

repeating the bending step until a desired shape is imparted to said plate; and articulating the upper die to enable it to adjust articulating to a contour of said plate during each bending thereof thereby limiting bending stress upon said ram.

9. A method of operating a bending press for the bending of steel plate for the production of large diameter pipe, which comprises the steps of:

placing a steel plate on a lower die on a bed of a bending press in which said lower die comprises a pair of supports enabling said plate to be bent between them;

pressing an upper die against said plate from above at the bottom of a sword-shaped ram driven by a head of the press downwardly to bend said plate; and articulating said upper die during the bending of said plate so as to minimize a bending moment on said ram.

* * * * *